US005667111A

United States Patent [19]

Robinson et al.

[11] Patent Number: 5,667,111

[45] Date of Patent: Sep. 16, 1997

[54] PLASTIC POUR-SPOUT AND CONTAINER

[75] Inventors: Walter G. Robinson, Charlotte, N.C.; David B. Dupes, York, S.C.

[73] Assignee: Poly Pro, Division of Roberts Systems, Inc., Charlotte, N.C.

[21] Appl. No.: 480,835

[22] Filed: Jun. 7, 1995

[51] Int. Cl.[6] ..... B67D 5/06

[52] U.S. Cl. ..... 222/508; 222/528; 222/536

[58] Field of Search ..... 222/508, 528, 222/533, 534, 536

[56] References Cited

U.S. PATENT DOCUMENTS

| | | | |
|---|---|---|---|
| 443,154 | 12/1890 | Wagamdt . | |
| 3,057,525 | 10/1962 | Malachick | 222/536 X |
| 3,438,555 | 4/1969 | La Pierre | 222/528 |
| 3,565,300 | 2/1971 | Dietz et al. | 222/528 |
| 3,843,029 | 10/1974 | Bezzecchi | 222/533 |
| 3,989,171 | 11/1976 | Arneson | 222/541 |
| 4,150,778 | 4/1979 | Engdahl, Jr. | 229/17 R |
| 4,192,440 | 3/1980 | Smith | 222/528 |
| 4,194,677 | 3/1980 | Wysocki | 229/17 R |
| 4,475,683 | 10/1984 | Vogt | 229/7 R |
| 4,760,938 | 8/1988 | Wenger | 222/498 |
| 5,014,888 | 5/1991 | Bryan | 222/541 |
| 5,078,872 | 1/1992 | Durant et al. | 210/232 |

*Primary Examiner*—Joseph Kaufman

*Attorney, Agent, or Firm*—Hardaway Law Firm P.A.

[57] ABSTRACT

A novel container having a plastic pour spout is provided, the container carrying a pour spout having a platform, a first side panel connected by hinge to the platform on a first side and a second panel connected by hinge to the platform on a second side, the two side panels having a substantially triangular shape. The hinged connection of the panels to the platform permit each pour spout to be provided in a flattened configuration in which the side panels are folded relative to the platform for insertion into an unerected carton. Following insertion, the panels again relax along the hinge-line and permit subsequent processing of the flattened carton stock. When the carton is folded, the panels move passively in response to the carton folding steps and assume an assembled configuration as the carton is assembled.

3 Claims, 6 Drawing Sheets

PLASTIC POUR-SPOUT AND CONTAINER

This invention relates to a reclosable pour-spout for a container. Currently, reclosable containers using pour-spouts are provided by metal spouts, spouts formed by the carton material, or three-dimensional injection-molded spouts. Metal spouts are difficult to engage and are prone to injuring users by inflicting minor cuts and abrasions. Further, metal spouts are subject to rust and deterioration which is frequently hastened by reactive container contents. Further, metal spouts and injection molded spouts are installed in the container during the filling steps of the carton. Industry-wide changes now make it more economical to provide carton stock for filling which requires minimal additional handling such as installing pour spouts. Accordingly, there is a need for pour-spouts which can be installed prior to filling, which can maintain a substantially flat profile for stacking of carton stocks, and which permits traditional handling and folding of the carton stock material. Accordingly, there is room for improvement and variation in the art of pour-spouts.

OBJECTS OF THE INVENTION

It is an object of this invention to provide a plastic pour-spout for use with a cardboard container.

It is to a further and more particular object of this invention to provide a plastic pour-spout which can be installed on a carton blank prior to the folding and filling of the carton.

It is to a further and more particular object of this invention to provide a novel container having a pour-spout which is easily engaged by the consumer.

These and other objects of the invention are provided by a plastic pour spout comprising:

a platform; a first side panel hingedly connected to a first side of the platform, the first side panel having a substantially triangular shape with a base in communication with a first platform hinge connection, the first side panel tapering to a first tip, the first side panel further defining an angular projection near the first tip;

a second side panel hingedly connected to a second side of the platform, said second side panel having a substantially triangular shape with a base in communication with a second platform hinge connection, the second side panel tapering to a second tip, the second side panel further defining an angular projection near the second tip;

wherein, the first and the second platform hinge connectors permit the pour spout to be placed in an assembled, three-dimensional configuration by the passive folding of the pour spout panels as a carton carrying the pour spout is assembled.

The pour spout defines a first platform hinge connection and a second platform hinge connection further comprising a first and second scoreline and providing a hinge connection with weak memory.

A process of assembling a container having a pour spout is also disclosed comprising the following steps:

providing an unfolded article of carton stock having at least one flat surface; providing a first slit and a second slit in the flat carton surface; creating a perforation connecting a portion of the first slit and second slit, thereby providing a carton flap; providing a pour spout comprising a central platform hingedly connected to a first side panel and a second side panel, the pour spout having an initial flattened configuration; folding the first side panel and the second side panel to a an approximate 90° angle relative to the platform; inserting the first panel into the first carton slit; inserting the second panel into the second carton slit; securing the flap to an inner surface of the platform; relaxing the first panel and the second panel so that the pour spout resumes a substantially flattened configuration; and folding the carton stock article into an assembled container, the pour spout panels folding along with the container into an assembled pour spout configuration.

DETAILED DESCRIPTION

Figure 1:
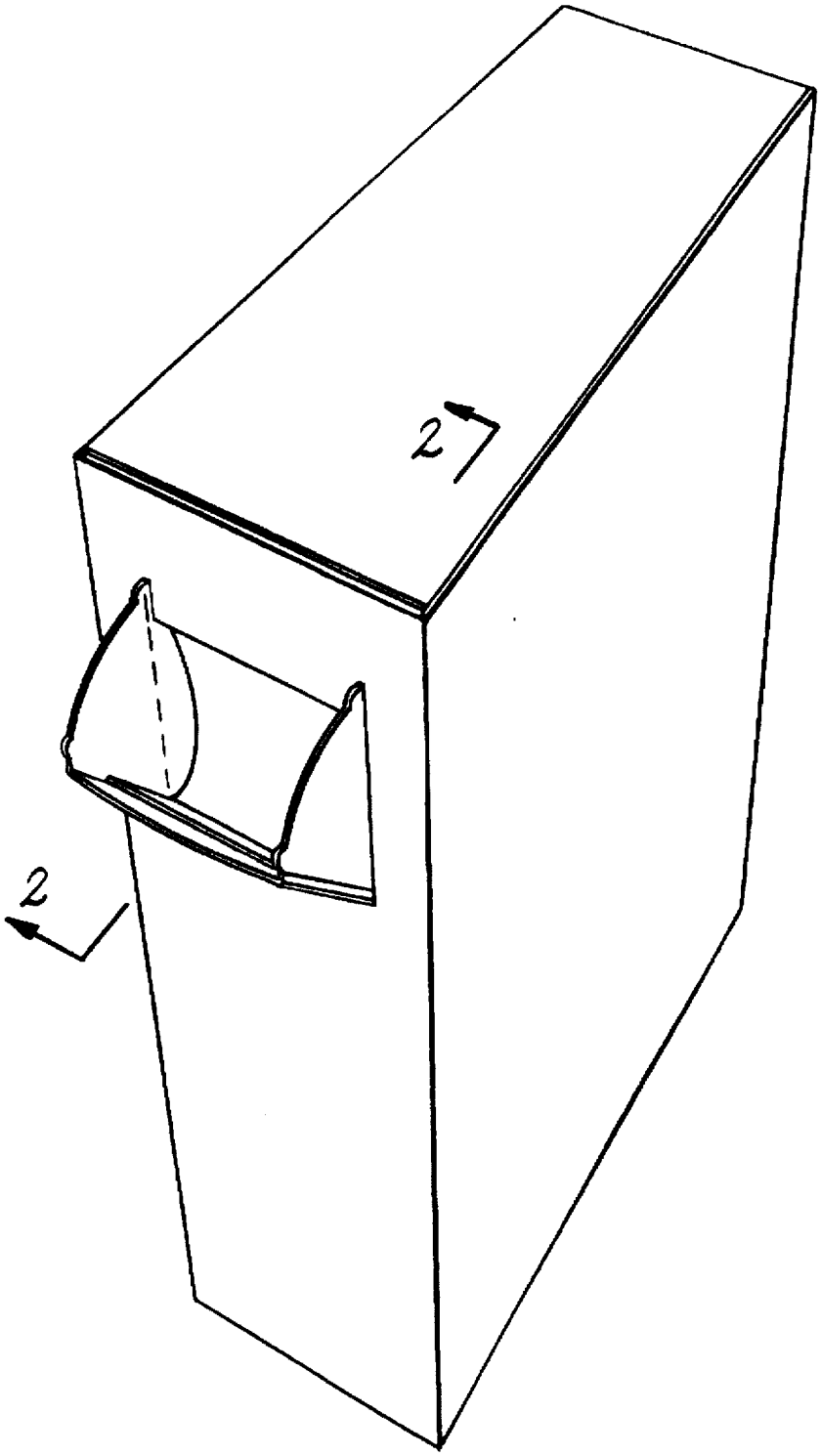
FIG. 1 is a perspective view of a preferred embodiment of the plastic pour-spout as carried by a carton.
Figure 2:
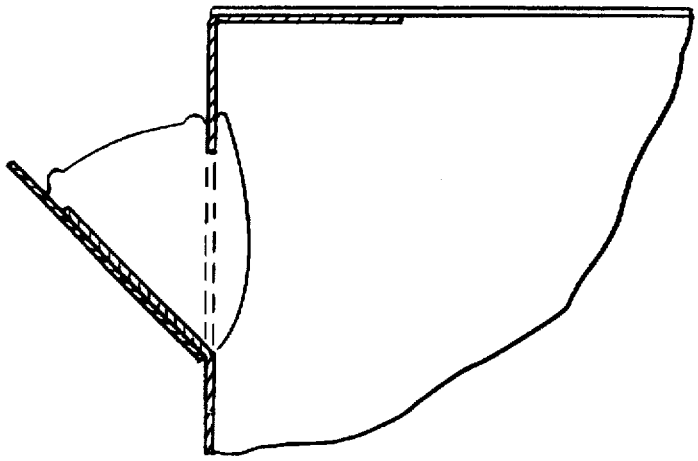
FIG. 2 is a section view taken along line 2—2 of FIG. 1.

As seen in reference to FIGS. 1–3B, a preferred embodiment of the present invention is provided by a pour-spout 1 comprising a central pouring platform 3, having an arcuate upper-edge 5 and a curved lower-edge 7. Adjacent a first platform side are a pair of parallel scorelines 9A and 9B, which run the length of the first side. A similar pair of scorelines 11A and 11B are adjacent the second platform side. A first substantially triangular side panel 20 is carried adjacent the first side of platform 3 and is in integral communication with scoreline 9A. Panel 20 further defines a curved, free-edge 21. An upper surface 23 of panel 20 provides a first projection 25 and second projection 27 which span an intervening arcuate surface. A notch 28 is defined between outer edge 21 and the second projection 27, notch 28 extending below the surface line of the adjacent arcuate surface. The corner formed by the upper-surface 23 and edge 21 define a shoulder region 29. Relative to surface 23, shoulder 29 projects above the plane of surface 23.

Figure 3A:
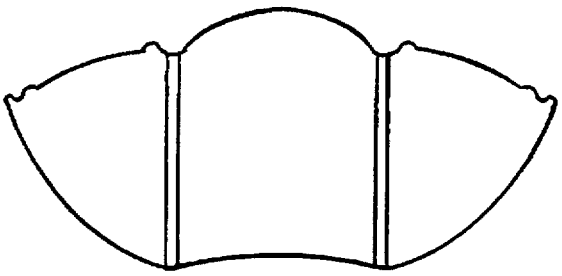
FIG. 3A is a plan view of the preferred embodiment of the pour spout seen in FIGS. 1 and 2.
Figure 3B:
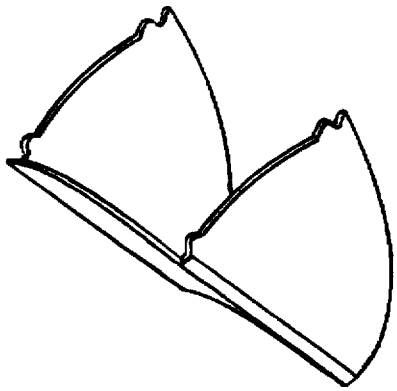
FIG. 3B is a perspective view of the preferred embodiment of the spout seen in FIG. 3A.

A second substantially triangular side panel 30 is a symmetrical, mirror image of panel 20 and is carried adjacent the second side of platform 3 and in integral communication with scoreline 11A. Panel 30 further defines a curved free-edge 31. An upper surface 33 of panel 30 provides a first projection 35 and a second projection 37 which span an intervening arcuate surface. A notch 38 is defined between the outer-edge 31 and the second projection 37, notch 38 extending below the surface of the adjacent arcuate surface. The corner formed by upper-surface 33 and edge 31 defines a shoulder region 39. Relative to surface 33, shoulder 39 projects above the plane of surface 33. As seen in FIG. 3B, detents 26 and 36 are created between the upper surface of platform 3 and the respective projections 25 and 35 of panels 20 and 30. In the folded configuration, the detents 26 and 36 help secure the reclosable pour spout in the closed position by the engagement of cut edges of the carton and/or an optional template seen in FIG. 8.

Figure 4A:
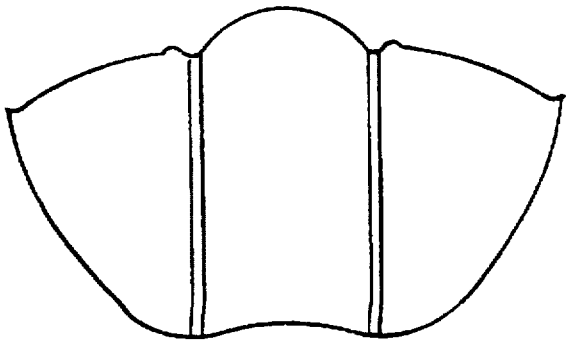
FIGS. 4A and 4B are a respective plan view and perspective view of a first alternative embodiment of a pour spout
Figure 4B:
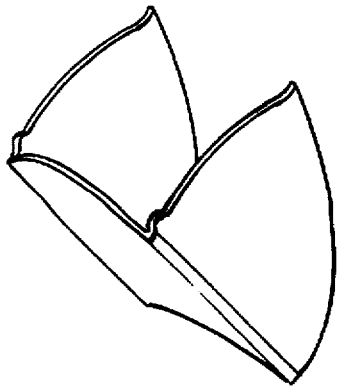

FIGS. 4A–6B illustrate alternative embodiments of the present invention. Where applicable, the same reference numerals used to describe the preferred embodiment are repeated and incorporated herein. As seen in FIGS. 4A and 4B, shoulders 29 and 39 can each further define a pointed projection 41. The added height of projection 41 operates as a mechanical stop for the open spout without the need of a further notch or detent structure. Panel edges 21 and 31 are substantially straight.

Figure 5A:
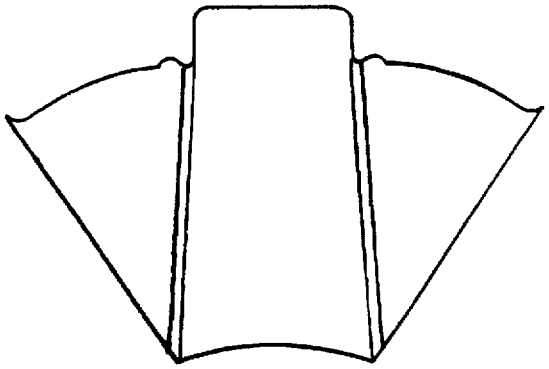
FIGS. 5A and 5B are a respective plan view and perspective view of a second alternative embodiment of a pour spout.
Figure 5B:
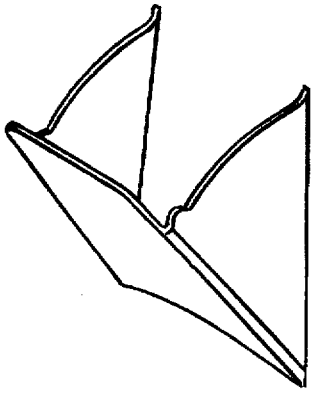

In FIGS. 5A and 5B, a second additional embodiment is illustrated. Platform 3 defines an upper margin 105 having a substantially straight outer edge. Margin 105 extends above the adjacent projections 25 and 35. A similar point 41 is provided as described in reference to FIGS. 4A and 4B. Panel edges 21 and 31 are substantially straight.

Figure 6A:
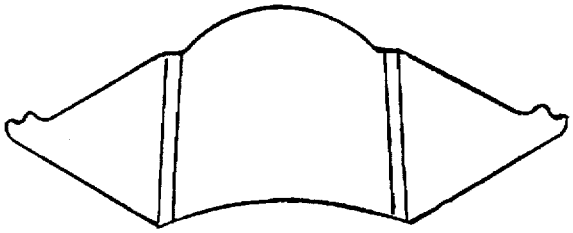
FIGS. 6A and 6B are respective plan view and perspective view of a third alternative embodiment of a pour spout.
Figure 6B:
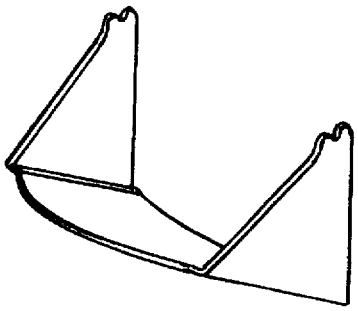

A third additional embodiment, seen in FIGS. 6A and 6B, provides a substantially flat shoulder region 61 in proximity to the scorelines adjacent platform edge 5. The upper engaging surface 63 of each panel is substantially straight, terminating in a first raised step 65 adjacent a raised straight ridge 67. Ridge 67 further defines a far wall 69 which is substantially straight and intersects with edge 21. In operation, shoulder 61 provides a mechanical stop for maintaining the spout in a closed position. Similarly, step 65 and ridge 67 define a stop or detent which maintains the pour spout in an open position.

As seen in reference to FIGS. 7A–7D a typical paperboard carton 60 defines a first side panel 50 and front and back panels 71 and 73. A pair of slits 51A and 51B traverse side panel 50 as well as any associated inner liner (not illustrated). The distance between slits 51A and 51B corresponds to the width of platform 3. A partial perforation line 55 connects an upper portion of slit 51B to a corresponding location on slit 51A, thereby defining a flap 53. As seen in FIG. 3, terminal portions 57 of slits 51A and 51B extend above the perforation line 55.

Figure 7A:
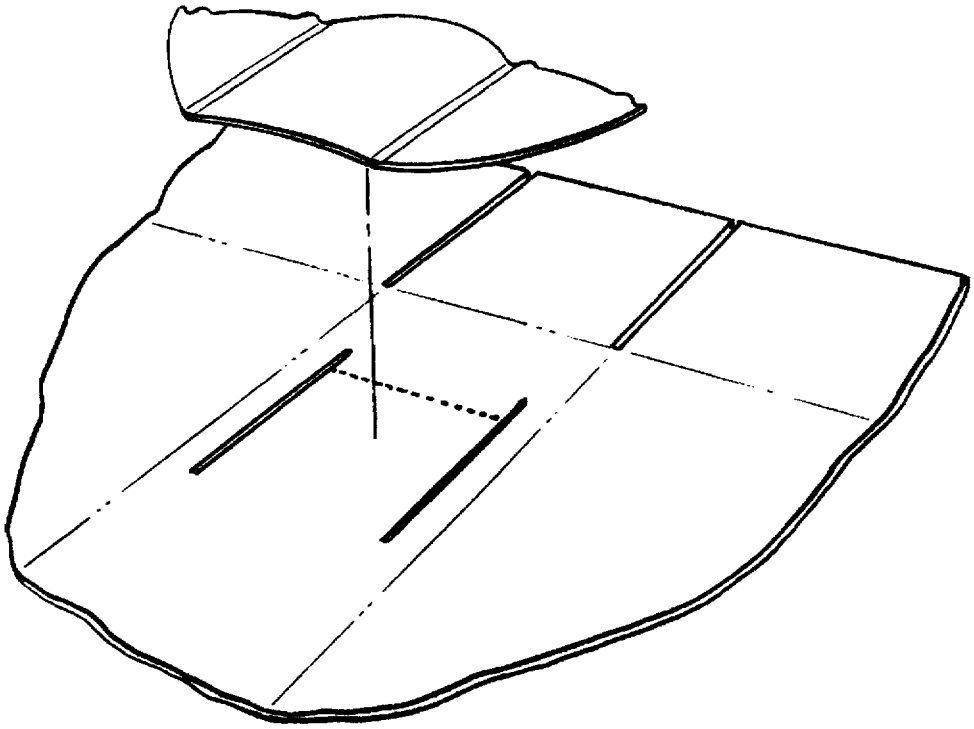
FIGS. 7A–7D illustrate a preferred embodiment of the invention as inserted into a flat carton blank and subsequently folded along with the carton blank.
Figure 7B:
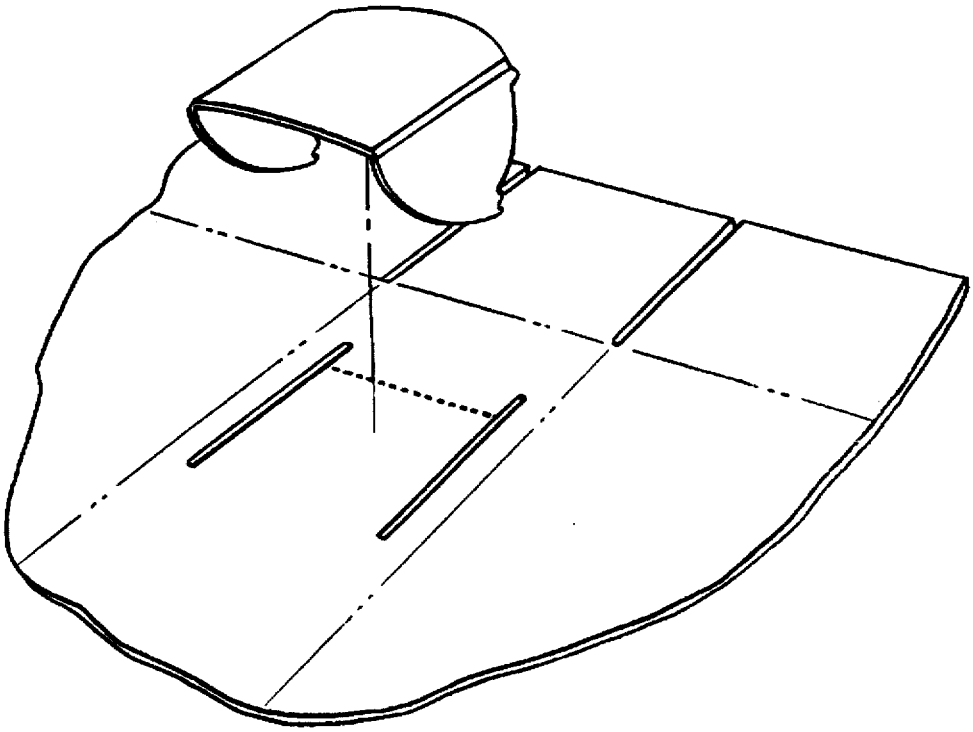

Slits 51A and 51B provide slots for the insertion of the respective triangular panels 30 and 20 of pour-spout 1. As seen in FIG. 7B, panels 20 and 30 can be inserted in tandem into corresponding slits 51A and 51B. As illustrated, the tapered terminus of each panel associated with projecting tips 29 and 39 may be the initial inserted spout portions. Alternatively, the spout can be pivoted into position from an initial lower or upper edge placement. An adhesive, not illustrated, is placed between carton flap 53 and the inner surface of platform 3 so that upper edge 5 extends above the perforation line 55 and provides an edge which can be easily grasped by the consumer.

Figure 7C:
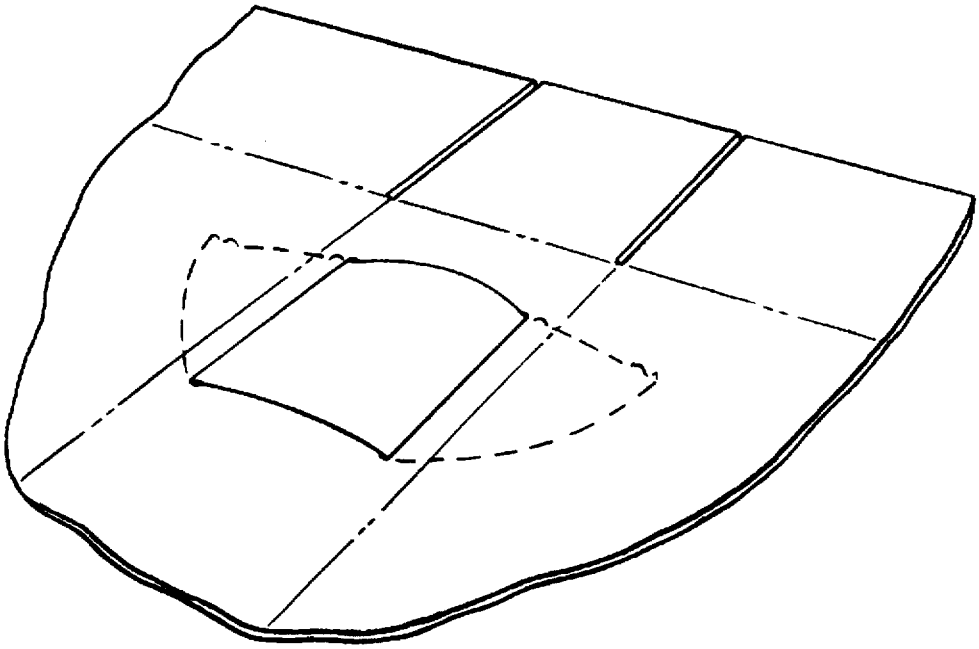
Figure 7D:
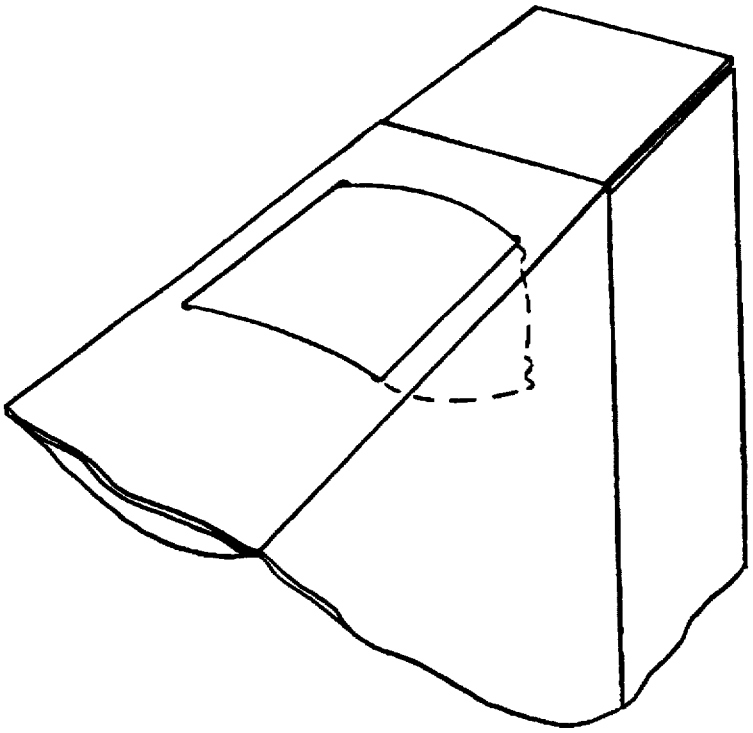

As seen in FIG. 7C, as platform 3 is placed and glued into engagement with flap 53, the panels 20 and 30 relax along the double scorelines such that the pour-spout can resume a substantially flat configuration. Accordingly, panels 20 and 30 facilitate the transport and stacking of unfolded carton stock carrying pour spout 1 without excess shingling of the stacked supply. Further, the panels 20 and 30 are passively folded relative to the platform 3 of the carton stock as assembled in field. Although not essential, it is preferred that the scorelines connecting panels 20 and 30 to platform 3 have a sufficiently weak memory so that once engaged and opened, the panels tend to remain at an approximate right angle to the platform when the spout is closed. The double score line hinged connection is preferred though single score line hinges will suffice.

Once opened, the pour spout and attached flap 53 will pivot to a fully opened position, notches 28 and 38 of the preferred embodiment engaging the cut margin of the carton along the upper portion 57 of carton slits 51A and 51B. Projections 41 of the alternative embodiments (FIGS. 4A–5B) provide a similar stop for the open pour spout.

To close, the pour-spout and flaps are returned to the original position. Panels 20 and 30 may relax in the closed position and do not have to maintain the substantially right angle relative to the platform seen in the open position. The position and spacing of the carton slits will restore the proper pouring geometry each time the spout is engaged.

Points 25 and 35 provide a closure stop to secure the spout in a closed position, the cut margin of the carton being engaged by a detent formed between the each respective point 25 and 35 and the hinge region 10. The alternative embodiment seen in FIGS. 6A and 6B is retained in the closed position by a frictional engagement between the carton and shoulders 61.

Figure 8:
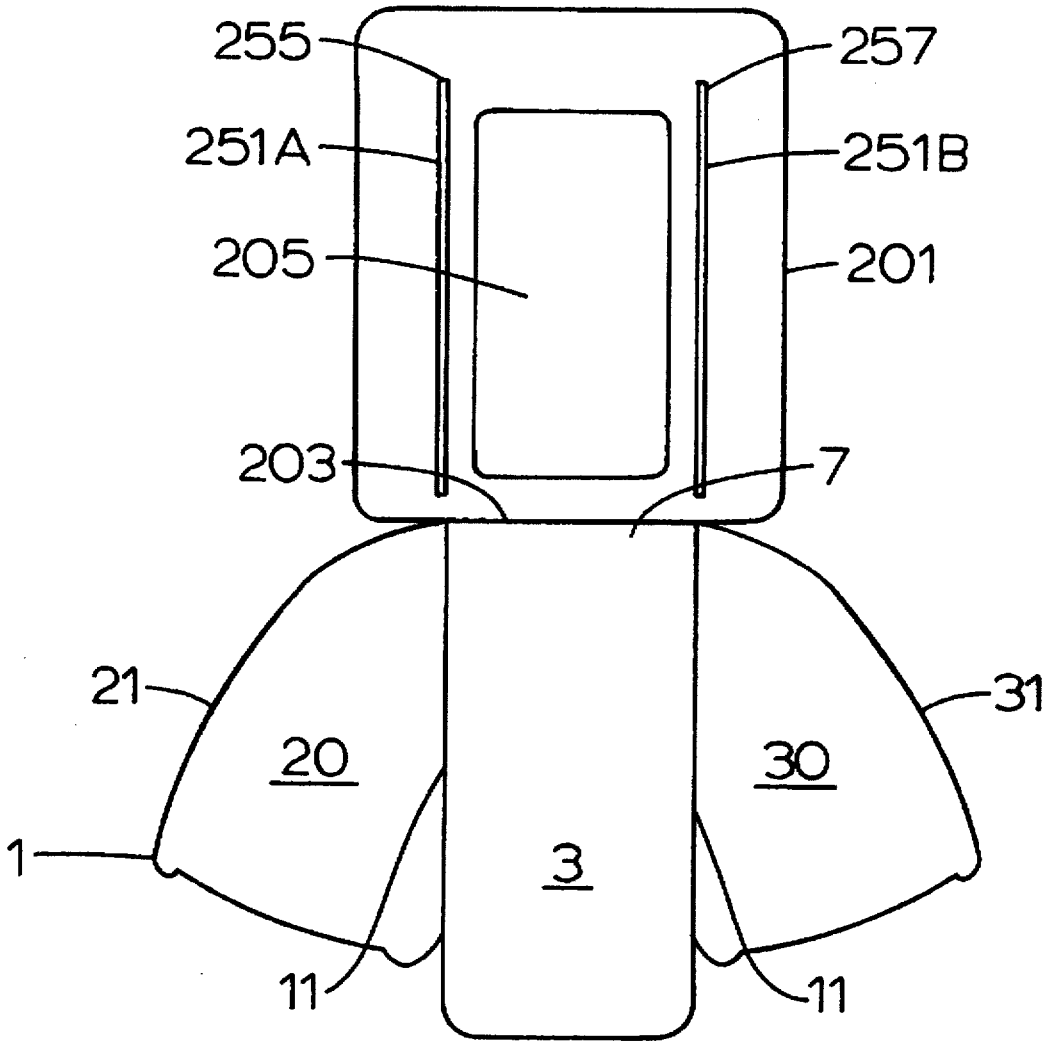
FIG. 8 is a plan view of a fourth alternative embodiment of a pour spout with an integral template, the template being carried by a carton and receiving the folded pour spout.

As seen in FIG. 8, an additional alternative embodiment is illustrated in which the pour spout 1 is attached at a base 7 to a plastic carton scoring template 201. An integral hinge line 203 facilitates the folding of the pour spout relative to the template 201. Template 201 is positioned against carton panel 50 (FIG. 7A) so that template guide cuts 251A and 251B are in alignment over carton scores 51A and 51B. A template aperture 205 is in register with carton flap 53 as template 201 is secured against the carton panel by an adhesive. In reference to FIG. 8, when panels 20 and 30 are folded upwardly along scorelines 11, the panel edges 21 and 31 are able to be inserted into guide cuts 251A and 251B respectively as pour spout 1 folds along base hinge 203. As previously described, carton tab 53 is then glued against the inner platform 3.

The above embodiment will also facilitate stacking of carton stock articles and provides additional stability for the open and closed pour spout positions in that the previously described stops and detents now operate in cooperation with template guide edges 255 and 257.

An advantage of the current pour spout embodiments over prior art injection molded or metal spouts is the ability to install the pour spout 1 while the carton is in a flat, unerected configuration. Pour spout 1 is preferably die-stamped from plastic sheets such as polyethylene. Concurrent with the dye stamping process, the scorelines referenced above are created, permitting the side panels 20 and 30 to bend relative to platform 3.

A plurality of pour-spouts can be assembled in a stacked, flattened cartridge configuration, as well known in the art, for high-speed, singular displacement. As each spout is displaced, side-panel 20 and side-panel 30 are each placed into the folded configuration similar to that seen in FIG. 7B. Panel edges 21 and 31 are then inserted into the corresponding carton slot 51B and 51A, where panels 20 and 30 may relax to permit stacking of the unfolded carton stock.

The polyethylene sheet from which a pour-spout 1 is stamped preferably has a thickness of between 0.028–0.035 inches. This gauge plastic is desirable for cartridge formation for high-speed, singular dispensing. This thickness of spout fits well within the carton stock slits, forms well-defined notches, and is sufficiently thick that the consumer can grasp and open the sealed spout/carton combination.

As initially installed, the pour-spout can assume a substantially flat configuration and facilitates the high-speed transport, stacking, and assembly of the cartons. Further, the spout can be installed at the converting plant stage of carton construction as opposed to the subsequent product filling stage. This, in-turn, lowers the net product cost and increases filling efficiency.

As many variations will become apparent to one having skill in the art, the scope of the present invention is defined by the following claims.

That which is claimed:

1. A plastic pour spout comprising:

a platform;

a first side panel hingedly connected to a first side of said platform, said first side panel having a substantially triangular shape with a base in communication with a first platform double hinge connection, said first side panel tapering to a first tip, said first side panel further defining an angular projection near said first tip; and a second side panel hingedly connected to a second side of said platform, said second side panel having a substantially triangular shape with a base in communication with a second platform double hinge connection, said second side panel tapering to a second tip, said second side panel further defining an angular projection near said second tip;

wherein, said first and said second platform double hinge connectors permit said pour spout to be placed in an assembled, three-dimensional configuration by the passive folding of the pour spout as a carton carrying the pour spout is assembled.

2. The pour spout according to claim 1 wherein said first platform hinge connection and said second platform hinge connection are each defined by a pair of scoreline.

3. A container having a reclosable pour spout comprising:

a first flat panel, said panel defining a first slit, a second slit, and a perforation connecting an upper region of said first slit to said second slit, thereby forming a flap;

a plastic pour spout, said spout defining a platform, a first side panel connected by a double hinge to a first side of said platform, a second side panel connected by a double hinge to a second side of said platform, said first and said second side panels each having a substantially triangular shape with their respective base in communication with said platform, each said panel tapering to a tip, each said panel further defining an angular projection near each said tip;

said first panel traversing said first slit and in communication with an interior of said container, said second panel traversing said second slit and in communication with said interior of said container.

* * * * *